US005801742A

United States Patent [19]

Wiedemer

[11] Patent Number: 5,801,742

[45] Date of Patent: Sep. 1, 1998

[54] THERMAL TRANSFER PRINTING DEVICE FOR TRANSFERRING A PRINTING IMAGE ONTO A RECORDING MEDIUM

[75] Inventor: Manfred Wiedemer, Ismaning, Germany

[73] Assignee: Océ Printing Systems GmbH, Poing, Germany

[21] Appl. No.: 700,503

[22] PCT Filed: Nov. 29, 1994

[86] PCT No.: PCT/DE94/01418

§ 371 Date: Aug. 20, 1996

§ 102(e) Date: Aug. 20, 1996

[87] PCT Pub. No.: WO95/23065

PCT Pub. Date: Aug. 31, 1995

[30] Foreign Application Priority Data

Feb. 23, 1994 [DE] Germany ..... 44 05 840.3

[51] Int. Cl.[6] ..... B41J 2/32

[52] U.S. Cl. ..... 347/171; 347/213; 8/467

[58] Field of Search ..... 347/213, 171, 347/172, 174, 175, 119, 217, 66, 91, 103; 8/467; 346/76.1

[56] References Cited

U.S. PATENT DOCUMENTS

| | | | |
|---|---|---|---|
| 3,834,301 | 9/1974 | Croquelois et al. | 347/55 |
| 4,725,860 | 2/1988 | Kohyama | 346/140 |
| 4,731,619 | 3/1988 | Miura et al. | 347/201 |
| 5,159,357 | 10/1992 | Ng et al. | 346/157 |
| 5,170,187 | 12/1992 | Oikawa | 347/66 |
| 5,175,568 | 12/1992 | Oyamaguchi et al. | 347/113 |
| 5,347,344 | 9/1994 | Itoh | 355/200 |

FOREIGN PATENT DOCUMENTS

| | | |
|---|---|---|
| 0 195 863 | 10/1986 | European Pat. Off. . |
| 0 202 370 | 11/1986 | European Pat. Off. . |
| 0 437 612 | 7/1991 | European Pat. Off. . |

OTHER PUBLICATIONS

Japanese Abstract, M-722, Jul. 26, 1988, vol. 12, No. 267, 63-49434, Mar. 2, 1988, pp. 199-202.

Japanese Abstract, M-998, Jul. 13, 1990, vol. 14, No. 327, 2-111553, Apr. 24, 1990, pp. 351-355.

Japanese Abstract, M-810, Apr. 6, 1989, vol. 13, No. 140, 63-303748, Dec. 12, 1988, pp. 259-262.

Japanese Abstract, M-564, Feb. 21, 1987, vol. 11, No. 57, 61-219652, Sep. 30, 1986, pp. 273-277.

Japanese Abstract, M-1037, Oct. 19, 1990, vol. 14, No. 481, 2-194962, Aug. 1, 1990, pp. 409-411.

*Primary Examiner*—N. Le
*Assistant Examiner*—Anh Vo
*Attorney, Agent, or Firm*—Hill & Simpson

[57] ABSTRACT

A printing image is transferred onto a first fabric tape (1), which can be wetted with a liquid (19), at a printing image transfer point (3) as a result of the partial evaporation of the included liquid (19). At a subsequent transfer printing point (12), the first fabric tape (1) is located between a heating device (10) and a second fabric tape (4). Printing ink (11) is included in the second fabric tape (4). This printing ink (11) is expelled from the second fabric tape (4) by the liquid (19), which remained in the first fabric tape (1) and represents the printing image and which evaporates at the transfer printing point (12), and is transferred onto a recording medium (9).

10 Claims, 1 Drawing Sheet

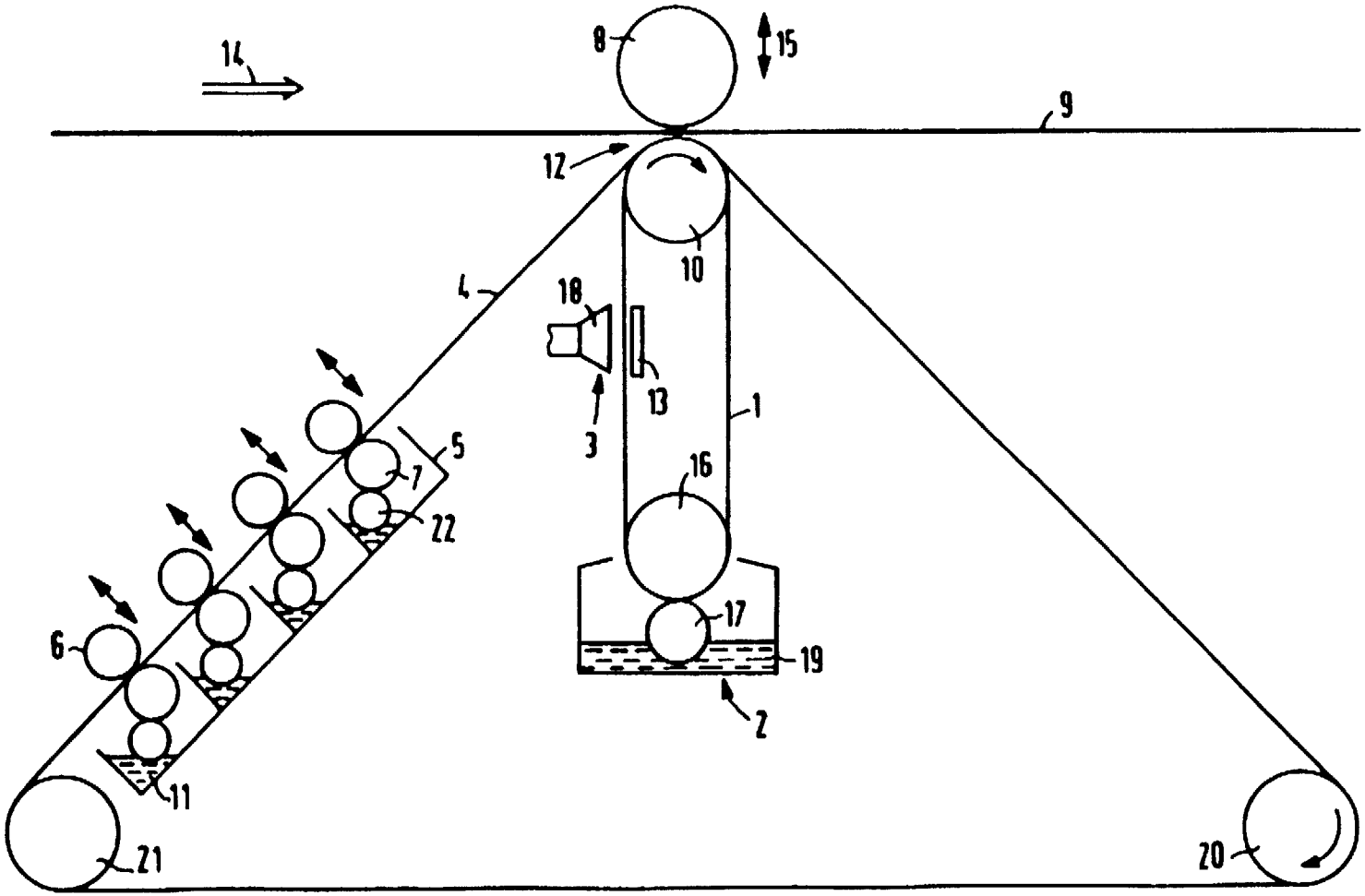
9
15
8
12
10
1
13
18
3
16
17
19
2
4
5
7
22
14
6
11
21
20

THERMAL TRANSFER PRINTING DEVICE FOR TRANSFERRING A PRINTING IMAGE ONTO A RECORDING MEDIUM

BACKGROUND OF THE INVENTION

1. Field of the Invention

The present invention relates to a thermal transfer printing device for transferring a printing image onto a recording medium in a printer or copier.

2. Description of the Related Art

U.S. Pat. No. 4,731,619 discloses a thermal printing head of a thermal transfer printing device. The thermal printing head is arranged at a transfer printing point. At this transfer printing point, a printing image is transferred onto a recording medium. A printing ink film is transported between the thermal printing head and the recording medium in a direction of transport of the recording medium. This printing ink film has a plurality of small orifices, in which printing ink is contained. This printing ink is introduced into the orifices of the printing ink film in an inking station. At the transfer printing point, the printing ink film slides over the thermal printing head and at the same time is preheated. The thermal printing head has a plurality of individually activatable heating elements which serve for the rapid heating of the printing ink in the orifices of the printing ink film. The heating elements are activated by a control unit in accordance with the printing image to be reproduced. The rapid heating of the printing ink causes bubbles to form in the orifices of the printing ink film, with the result that the printing ink is instantly expelled from the orifices in the direction of the recording medium.

By means of the known method, high-viscosity printing inks with a high pigment concentration can be transferred onto the recording medium. Half-tones too can be printed thereby, as a result of which color images of photographic quality can also be produced. In the known thermal transfer printing device, however, considerable requirements are placed on the printing ink. Thus, the printing ink has to be thermally stable up to about 400° C. According to the temperature of the printing ink, the thermal load on the surface of the recording medium also rises. Only recording media which meet these stringent requirements can therefore be used. Since the heating operation is restricted to the relatively small region of the printing head, the printing speed obtainable is also limited correspondingly.

European Patent Document 0,202,370 discloses a thermal transfer printing device having a plurality of thermal printing heads. Each thermal printing head serves for transferring a printing ink onto a recording medium. Each thermal printing head is assigned a cartridge having a printing ink reservoir, in which the orifices of a printing ink film are filled with printing ink. The printing ink film is guided over the thermal printing head, where the printing ink is heated and is transferred onto a recording medium as a result of the formation of bubbles. In multicolor printing, a plurality of transfer printing points corresponding to the number of inks are required.

SUMMARY OF THE INVENTION

An object on which the present invention is based is to provide a thermal transfer printing device for transferring a printing image onto a recording medium in a printer or copier, the thermal transfer printing device allowing the use of conventional printing inks which do not withstand high thermal stresses, guaranteeing a low thermal load on the recording medium and permitting a high printing speed.

This and other objects of the present invention are achieved by a thermal transfer printing device for transferring a printing image onto a recording medium in a printer or copier, the device having a first fabric tape which can be wetted with a liquid, a printing image transfer point at which the liquid can be partially evaporated out of the first fabric tape according to the existing printing information, a second fabric tape onto which printing ink can be transferred in an inking station, and a transfer printing point at which the first fabric tape and the second fabric tape are jointly guided, one on top of the other, over a heating device, the first fabric tape being in touch contact with the heating device, with the result that the liquid contained in the first fabric tape evaporates, and the recording medium can be pressed relative to the second fabric tape in the direction of the heating device by a pressure element. Developments and embodiments of the invention are provided by a first fabric tape that is composed of a high-grade steel wire fabric. The second tape of the thermal transfer printing device may be a polyester fabric having a fabric thickness of<100 μm.

Preferably, the heating device extends transversely relative to the direction of transport of the recording medium and is a heatable roller. The inking station preferably provides, by the selective movement of a backing roll, an ink-carrying roller that can be brought into touch contact with the second fabric tape. The inking station has at least two ink-carrying rollers are arranged in succession in the direction of run of the second fabric tape.

The thermal transfer printing device wherein the printing image transfer point has a thermal comb having heating elements activatable independently of one another, one heating element corresponding to one pixel of the printing image. The dampening unit is arranged at the first fabric tape and the first fabric tape can thereby be wetted with a nontoxic liquid. In particular, the dampening unit contains two rollers rolling one on the other, between which the first fabric tape can be transported through and one of which transfers the liquid onto the first fabric tape. The thermal transfer printing device uses endless tapes as the fabric tapes.

By means of the thermal transfer printing device according to the invention, it becomes possible to use conventional colorants in thermal transfer printing. The heat effect of the heating device provided at the transfer printing point is restricted to the liquid contained in the first fabric tape or web. This liquid is evaporated and thereby expels the printing ink from the second fabric tape or web in the direction of the recording medium. The printing ink that strikes the recording medium is heated only slightly, with the result that the recording medium is subjected to only a slight thermal load. The liquid is evaporated in the first fabric tape at a position spaced from the printing location so that the total energy for producing the image is emitted at two spaced locations. Since the printing image is produced at two different points the thermal load on the heating device located at the transfer printing point is comparatively slight. Additionally, the division of the printing energy can also be utilized in order to increase the printing speed.

The fabric tapes have the property of absorbing liquid or printing ink and of partially discharging this material again. The term "fabric tape" therefore also relates to tapes having an irregular structure, such as, for example, a fleece, and all other materials which have the functionality mentioned above.

According to one embodiment and development of the invention, the thermal transfer printing device contains an inking station, at which, by the selective movement of a backing roll towards an ink-carrying roller, the ink-carrying roller can be brought into touch contact with the second fabric tape located between the roller and the backing roll. This guarantees that printing ink is applied only at those points on the second fabric tape where this is required. For example, it is necessary to reload with printing ink only those points on a second fabric tape which is an endless tape from which ink was extracted in a preceding transfer printing operation.

According to a further embodiment of the invention, at least two-ink-carrying rollers are arranged in succession in the running direction of the second fabric tape. Consequently, different inks can be applied to the second fabric tape successively in portions at the desired points. Multicolor printing is therefore possible with only one ink-carrying fabric tape. Preferably, portions not wetted with printing ink are left free between the individual portions of different inking on the second fabric tape. In the event of a printing interruption, these ink-free regions are then positioned above the heating device of the transfer printing point.

According to a further development and embodiment of the invention, the printing image transfer point contains a thermal comb having heating elements activatable independently of one another, wherein one heating element corresponds to one pixel. By means of the thermal comb, the liquid can be partially evaporated out of the first fabric tape according to the existing printing information. The dot size and color density, which are to be achieved during the subsequent transfer printing in the transfer printing station, can be determined both by varying the heating energy on the heating device of the transfer printing station and by varying the heating energy of the heating elements of the thermal comb. Water is suitable as a nontoxic liquid with which the first fabric tape can be wetted. During the evaporation of water, no toxic vapors occur which could impair the ambient air of the printer or the operating elements inside the printer. The water vapor can be eliminated by means of a suction extraction device. However, other nontoxic liquids which have a corresponding evaporation point and do not cause any harmful environmental influences are also suitable.

BRIEF DESCRIPTION OF THE DRAWINGS

An example of the invention is explained in more detail below by means of the drawing.

The FIGURE shows a thermal transfer printing device with a first and a second fabric tape.

DETAILED DESCRIPTION OF THE PREFERRED EMBODIMENTS

The FIGURE shows a thermal transfer printing device for transferring a printing image onto a recording medium 9 in a printer or copier. The recording medium 9 is fed to a transfer printing point 12 in the direction of transport 14 of the recording medium. At the transfer printing point 12, a printing ink 11 located on a second fabric tape 4 is transferred onto the recording medium 9 according to printing information located on a first fabric tape 1.

The first fabric tape 1 is designed as endless tape. It is stretched between two rollers 10, 16, the axes of which are parallel. One of the rollers 10 is assigned to the transfer printing point 12 and the other roller 16 is assigned to a dampening unit 2. The first fabric tape 1 is at least as wide as the widest recording medium 9 to be processed. The length of the first fabric tape 1 is selected in such a way that the distance between the two rollers 10 and 16, onto which the first fabric tape 1 is stretched, is so great that a printing image transfer point 3 can be arranged in this distance region.

The printing image transfer point 3 contains a heating device 13, by means of which a nontoxic liquid 19 contained in the first fabric tape 1 can be partially evaporated according to the existing printing information. A thermal comb 13, such as is known, for example, from the initially mentioned U.S. Pat. No. 4,731,619, serves as a heating device 13. The thermal comb 13 contains a plurality of heating elements, to each of which one pixel of the printing information can be assigned. However, a laser or an infrared light source, which are appropriately controllable, could also be used as a heating device 13.

The thermal comb 13 extends over the entire width of the first fabric tape 1. The first fabric tape 1 is guided directly over the thermal comb 13. Provided on that side of the first fabric tape 1 facing away from the thermal comb 13 is a suction extraction device 18 which sucks away the evaporated liquid 19. The liquid 19, which is for example water, can be condensed in a condensation device (not shown) downstream of the suction extraction device 18 and fed again to the dampening unit 2.

At the printing image transfer point 3, liquid 19 is evaporated out of the first fabric tape 1, designed as a high-grade steel wire fabric with a fabric fineness>200 mesh, at the points at which no application of ink on the recording medium 9 is to take place. After the first fabric tape 1 has run through the printing image transfer point 3, therefore, liquid 19 is still located in the first fabric web 1 only at the points at which an application of ink onto the recording medium 9 is to take place.

This liquid 19 remaining in the first fabric tape 1 is evaporated at the transfer printing point 12 by means of the heating roller 10 serving as a heating device, with the result that the printing image passes onto the recording medium 9. Consequently, after the run through the transfer printing point 12, there is no longer any liquid 19 located in the first fabric tape 1. New liquid 19 is transferred into the first fabric tape 1 again in the dampening unit 2. The dampening unit 2 has two rollers 16, 17 which roll one on the other and between which the first fabric tape 1 can be transported through. One of the two rollers 17 dips into the liquid 19 located in the trough of the dampening unit 2. At the same time, the roller 17 is wetted with liquid 19. The liquid 19 is transferred onto the first fabric tape 1 as a result of the rolling of the roller 17 on the first fabric tape 1. The first fabric tape 1, when it leaves the dampening unit 2, is wetted completely with liquid 19.

The second fabric tape 4, like the first fabric tape 1, is designed as an endless tape. The second fabric tape 1 consists of polyester or of metallized polyester with a fabric thickness of <100 μm. The second fabric tape 4 has at least a width which corresponds to the width of the widest recording medium 9 to be printed. The second fabric tape 4 is guided over three rollers 10, 20, 21, the axes of which are parallel to one another. In the region of the heating roller 10, the first fabric tape 1 is located between the heating roller 10 and the second fabric tape 4. The direction of movement and speed of the tapes 1, 4 are identical.

Before it reaches the transfer printing point 12, the second fabric tape 4 runs through an inking station 5. In the inking station 5, four different printing inks 11 are selectively applied to the second fabric tape 4. The inking station 5 can, in this case, be constructed in a modular manner, with the result that any desired number of printing inks 11 can be applied to the second fabric tape 4. The application of ink takes place in each case by means of an ink-carrying roller 7 which is arranged on one side of the second fabric tape 4. On the opposite side of the second fabric tape 4, a backing roll 6 is assigned to the ink-carrying roller 7. This backing roll 6 is movable perpendicularly to the surface of the second fabric tape 4 under the control of a control device. If an application of ink is to take place, the backing roll 6 is moved towards the ink-carrying roller 7. During this movement, the backing roll 6 strikes the second fabric tape 4 and moves the latter relative to the ink-carrying roller 7. The second fabric tape 4 and the ink-carrying roller 7 thereby come into touch contact, as a result of which printing ink 11 is transferred from the ink-carrying roller 7 onto the second fabric tape 4. The ink-carrying roller 7 is continually wetted with printing ink 11 by means of a rolling movement on a supply roller 22 which dips into an ink supply 11.

The control device ensures that only one backing roll 6 is pressed towards an ink-carrying roller 7 in each case. Portions of different inking i.e. different colors of ink, can thereby be produced on the second fabric tape 4. Regions without printing ink 11 are provided between the individual portions, so that, in the event of a transfer printing interruption, one of these free regions can be guided into the region of influence of the heating device 10 at the transfer printing point 12.

The transfer of the printing image onto the recording medium 9 takes place at the transfer printing point 12. An evaporation process takes place at the transfer printing point 12 at those points at which liquid 19 is contained in the first fabric tape 1. The recording medium 9 is brought into touch contact with the second fabric tape 4 by a pressure element which is designed as a backing roll 8 and which is movable relative to the heating roller 10 in a direction 15 perpendicular to the recording medium 9. A liquid 19 present at this touch contact point in the first fabric tape 1 located between the second fabric tape 4 and heating roller 10 is evaporated. The evaporating liquid 19 expels the printing ink 11 out of the second fabric tape 4, with the result that the printing ink is deposited on the recording medium 9.

Although other modifications and changes may be suggested by those skilled in the art, it is the intention of the inventor to embody within the patent warranted hereon all changes and modifications as reasonably and properly come within the scope of his contribution to the art.

I claim:

1. A thermal transfer printing device for transferring a printing image onto a recording medium in a printer or copier, comprising:

a first fabric tape, means for wetting said first fabric tape with a liquid, a printing image transfer means for partially evaporating the liquid out of said first fabric tape according to predetermined printing information, a second fabric tape, means for transferring printing ink onto said second fabric tape in an inking station, and a transfer printing point including a heating device, means for jointly guiding said first fabric tape and said second fabric tape, one on top of the other, over said heating device, said first fabric tape being in touch contact with said heating device, with a result that liquid contained in said first fabric tape evaporates, and a pressure element operable to press the recording medium relative to said second fabric tape in a direction of said heating device.

2. The thermal transfer printing device as claimed in claim 1, wherein said first fabric tape comprises a high-grade steel wire fabric.

3. The thermal transfer printing device as claimed in claim 1, wherein said second fabric tape comprises a polyester fabric having a fabric thickness of <100μm.

4. The thermal transfer printing device as claimed in claim 1, wherein said heating device comprises a heatable roller extending transversely relative to a direction of transport of the recording medium.

5. The thermal transfer printing device as claimed in claim 1, further comprising:

an ink carrying roller in said inking station;

a backing roll mounted to be selectively movable in said inking station to bring said ink-carrying roller into touch contact with said second fabric tape.

6. The thermal transfer printing device as claimed in claim 5, wherein said ink carrying roller is a first ink carrying roller and further comprising:

a second ink carrying roller in said inking station arranged in succession in a running direction of said second fabric tape.

7. The thermal transfer printing device as claimed in claim 1, wherein said printing image transfer means includes a thermal comb having heating elements activatable independently of one another, one heating element corresponding to one pixel of said printing image.

8. The thermal transfer printing device as claimed in claim 1, wherein said means for wetting includes a dampening unit which is arranged at said first fabric tape and in which said first fabric tape is wetted with nontoxic liquid.

9. The thermal transfer printing device as claimed in claim 8, wherein said dampening unit includes two rollers rolling one on the other, between which said first fabric tape can be transported through and one of which transfers the liquid onto said first fabric tape.

10. The thermal transfer printing device as claimed in claim 1, wherein said first and second fabric tapes are endless tapes.

* * * * *